US006866164B2

(12) United States Patent
Branson et al.

(10) Patent No.: US 6,866,164 B2
(45) Date of Patent: Mar. 15, 2005

(54) CHILD RESISTANT DISPENSER

(75) Inventors: Mark K. Branson, Newburgh, IN (US); Clifton C. Willis, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 237 days.

(21) Appl. No.: 10/132,997

(22) Filed: Apr. 26, 2002

(65) Prior Publication Data

US 2003/0201283 A1 Oct. 30, 2003

(51) Int. Cl.[7] ..... B67B 5/00
(52) U.S. Cl. ..... 222/153.14; 222/556
(58) Field of Search ..... 222/153.14, 556

(56) References Cited

U.S. PATENT DOCUMENTS

| | | | |
|---|---|---|---|
| 3,307,752 | A | 3/1967 | Anderson |
| 3,419,198 | A | 12/1968 | Pettersen |
| 3,758,000 | A | 9/1973 | Mack |
| 3,826,394 | A | 7/1974 | Stull |
| 3,828,981 | A | 8/1974 | Linkletter |
| 3,845,872 | A | 11/1974 | Towns et al. |
| 3,869,057 | A | 3/1975 | Miller |
| 3,873,006 | A | 3/1975 | Fields |
| 3,927,805 | A | 12/1975 | Stull |
| 4,047,495 | A | 9/1977 | O'Brien |
| 4,065,035 | A | 12/1977 | Eissler |
| 4,065,037 | A | 12/1977 | Haller |
| RE29,793 | E | 10/1978 | Pehr |
| 4,124,151 | A | 11/1978 | Hazard |
| 4,170,315 | A | 10/1979 | Dubach et al. |
| 4,209,100 | A | 6/1980 | Uhlig |
| 4,220,262 | A | 9/1980 | Uhlig et al. |
| 4,236,653 | A | 12/1980 | Gach |
| 4,244,495 | A | 1/1981 | Lorscheid |

(List continued on next page.)

FOREIGN PATENT DOCUMENTS

| | | |
|---|---|---|
| DE | 74 25 021 | 2/1976 |
| EP | 0 634 338 A1 | 1/1995 |

*Primary Examiner*—Philippe Derakshani
(74) *Attorney, Agent, or Firm*—James E. Cole; Middleton Reutlinger

(57) ABSTRACT

A child resistant dispenser comprising a double-shelled threaded closure and dual opposed motion child resistant features. The child resistant dispenser comprises a double shelled closure having a first squeeze and turn child resistant feature. Hingeably attached to the closure is a lid. The lid has a squeeze and lift feature used to open the lid and access the dispenser comprising the second child resistant feature. The child resistant dispenser may be disposed on a container and in fluid communication therewith.

32 Claims, 6 Drawing Sheets

U.S. PATENT DOCUMENTS 4,257,537 A 3/1981 Uhlig
4,298,146 A 11/1981 Montgomery
4,310,105 A 1/1982 Gach
4,314,656 A 2/1982 Kessler
4,334,639 A 6/1982 Gach
4,444,326 A 4/1984 Musel
4,513,888 A 4/1985 Curry
4,718,567 A 1/1988 La Vange
4,723,669 A 2/1988 Barriac
4,749,103 A 6/1988 Barriac
4,756,451 A 7/1988 Wilson
4,759,455 A 7/1988 Wilson
4,776,475 A * 10/1988 La Vange ..... 215/216
4,787,525 A 11/1988 Joyce
4,790,442 A 12/1988 Gach
4,852,770 A 8/1989 Sledge
4,948,002 A 8/1990 Thornock et al.
4,979,648 A 12/1990 Montgomery et al.
5,031,784 A 7/1991 Wright
5,046,629 A 9/1991 Weile
5,088,628 A 2/1992 Knickerbocker
5,104,008 A 4/1992 Crisci
5,147,060 A 9/1992 Lima et al.
5,161,706 A 11/1992 Weinstein et al.
5,180,072 A 1/1993 Oehlert
5,213,223 A 5/1993 Minnette
5,230,433 A 7/1993 Hamilton et al.
5,314,093 A * 5/1994 Gross et al. ..... 222/153.14
5,328,058 A 7/1994 Leoncavallo et al.
5,348,201 A 9/1994 Koo
5,356,017 A 10/1994 Rohr
5,429,255 A 7/1995 Glynn
5,465,876 A 11/1995 Crisci
5,509,550 A 4/1996 DeJonge
5,577,624 A 11/1996 Berta et al.
5,579,957 A 12/1996 Gentile et al.
5,622,284 A 4/1997 Sawicki
5,671,853 A 9/1997 Herr
5,735,417 A 4/1998 Darr
5,749,496 A 5/1998 DeJonge, Sr. et al.
5,779,072 A 7/1998 Krebs
5,816,422 A 10/1998 Roig
5,819,967 A 10/1998 Lo
5,850,951 A 12/1998 Hayes
5,860,543 A 1/1999 Decelles
5,865,330 A 2/1999 Buono
5,899,348 A 5/1999 Konefal
5,908,125 A 6/1999 Opresco
5,915,576 A 6/1999 Robinson
5,927,526 A 7/1999 Herr
5,927,556 A 7/1999 Mooney et al.
5,979,681 A 11/1999 Varlet et al.
5,988,412 A 11/1999 Minnette et al.
5,996,859 A 12/1999 Beck
6,036,036 A 3/2000 Bilani et al.
6,039,196 A 3/2000 Ekkert et al.
6,053,343 A 4/2000 Krueger
6,076,689 A 6/2000 Vassallo
6,082,565 A 7/2000 Harrold
6,095,353 A 8/2000 Gargiulo
6,095,354 A 8/2000 Herr et al.
6,112,921 A 9/2000 Robinson
6,176,381 B1 1/2001 Mader
6,202,876 B1 3/2001 DeJonge
6,206,221 B1 3/2001 Bando et al.
6,216,905 B1 4/2001 Mogard et al.
6,234,334 B1 5/2001 Suarez
6,253,938 B1 7/2001 Zaksenberg et al.
6,257,431 B1 7/2001 Baudin
6,283,333 B1 9/2001 Knickerbocker et al.
6,299,005 B1 10/2001 Higgins
6,302,301 B1 10/2001 Vette
6,305,563 B1 10/2001 Fields
6,311,878 B1 11/2001 Kimble
6,325,252 B1 12/2001 Brozell et al.
2001/0032827 A1 10/2001 Montgomery et al.
2001/0040176 A1 11/2001 Kimble et al.
2001/0050264 A1 12/2001 Schorner

* cited by examiner

CHILD RESISTANT DISPENSER

BACKGROUND OF THE INVENTION

1. Technical Field of the Invention

The present invention relates generally to a child resistant dispenser. More specifically, the present invention relates to a child resistant dispenser having an opposed motion child resistant closure such as a squeeze and turn closure as well as an opposed motion child resistant dispenser such as a squeeze and lift flip-top.

2. Description of the Related Art

The U.S. Consumer Products Safety Commission (CPSC) recently enacted rules requiring child resistant (CR) packaging for household products containing hydrocarbons and having a low viscosity. The CPSC has documented a plurality of fatalities of children under the age of five years involving aspiration of hydrocarbon products. The American Association of Poison Control Centers has documented over 11,000 potential aspiration exposures to common household products containing hydrocarbons.

Aspiration of hydrocarbon products into a child's lungs causes a pneumonia-like condition, irreversible permanent lung damage, and even death. According to the Consumer Product Safety Commission, there are currently no known techniques for safely removing these oily substances from the lungs. In an effort to better protect children from ingestion and aspiration of low viscosity hydrocarbon containing products, the CSPC passed the above mentioned rule for manufacturers of low viscosity hydrocarbons.

In view of the new consumer products safety commission rules and deficiencies in known dispensing closures with respect to those rules, it is preferable to have a child resistant dispenser having a child resistant feature on the closure and the lid wherein each feature requires an opposed motion to deactivate a safety mechanism and access container contents.

SUMMARY OF THE INVENTION

It is an object of the present invention to provide a child resistant dispenser for use with a container that inhibits access to those of tender years yet may be easily accessible to adults.

It is a further objective of the present invention to provide a child resistant dispenser having dual child resistant features.

It is an objective of the present invention to provide a child resistant dispenser requiring opposed motions to disengage the child resistant features.

It is an even further objective of the present invention to provide a closure having child resistant (CR) lugs on a closure base requiring a "squeeze and turn" action and a "squeeze and lift" motion to open a flip-top lid.

It is still an even further objective of the present invention to provide a double shell closure wherein an outer skirt is flexible but an inner skirt does not flex thereby maintaining a seal with a container.

It is yet an even further objective of the present invention to provide a flip-top lid having locking prongs which lock beneath shoulders disposed on a closure top wall providing the second CR feature.

In particular, a child resistant dispenser is provided comprising a double shelled closure having a child resistant feature, a lid hingeably attached to the closure and having a child resistant feature, wherein the closure comprises a closure top wall and an outer annular skirt disposed about a peripheral edge of the closure top wall. The closure outer skirt has an upper portion and a lower portion, the upper portion being discontinuous and the lower portion having child resistant lugs disposed on an inner surface of the outer skirt and 90 degreed apart from first and second pressure points of the outer skirt. The outer skirt lower portion is flexible or deformable allowing ovalized flexure thereof for disengaging of the CR lugs. The closure also includes a dispensing orifice on the closure top wall. The closure CR feature may also include a push and turn design or some other CR closure design known to one skilled in the art.

The closure further comprises an inner skirt depending from the closure top wall. The inner skirt is rigid preventing flexing when the outer skirt is squeezed and thereby maintaining sealed engagement with a container.

The closure top wall may have a rotary seal depending therefrom such as a plug seal when for instance liquids are stored in the container. Alternatively, a seal may extend radially inward from an inner skirt near a container opening. When solids, such as vitamins are stored in the container having larger openings, an inner seal or foil seal may be used as a tamper indicating means. A linerless folding bead may also be used to seal the container by pressing against a lip of the container. These seals preferably provide a sealing engagement when the closure is disposed in a locked position in a container.

Disposed in the closure top wall is a dispensing orifice. Spaced apart about 180 degrees around the peripheral edge of the closure top wall are first and second apertures. Extending above the diametrically opposed first and second apertures are shoulders.

Hingeably attached to the closure is a flip-top lid. The lid has an discontinuous lid skirt depending from a peripheral edge thereof. Also depending from the flip-top lid are a first and a second prong. The first and second prongs have fingers extending outwardly opposite the lid top wall which lock beneath the shoulders of the closure top wall. This arrangement provides a second child resistant feature. The flip-top lid may also have an orifice plug or wrap around seal for sealingly engaging the dispensing orifice. The lid further comprises a removed portion defining a lip to aid in opening the flip top lid.

The lid and closure are hingeably connected. The hinge comprises a center hinge element and symmetrically disposed bias straps. Alternatively, the closure and flip-top lid may be formed separately and snapped together to form the hinge design.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
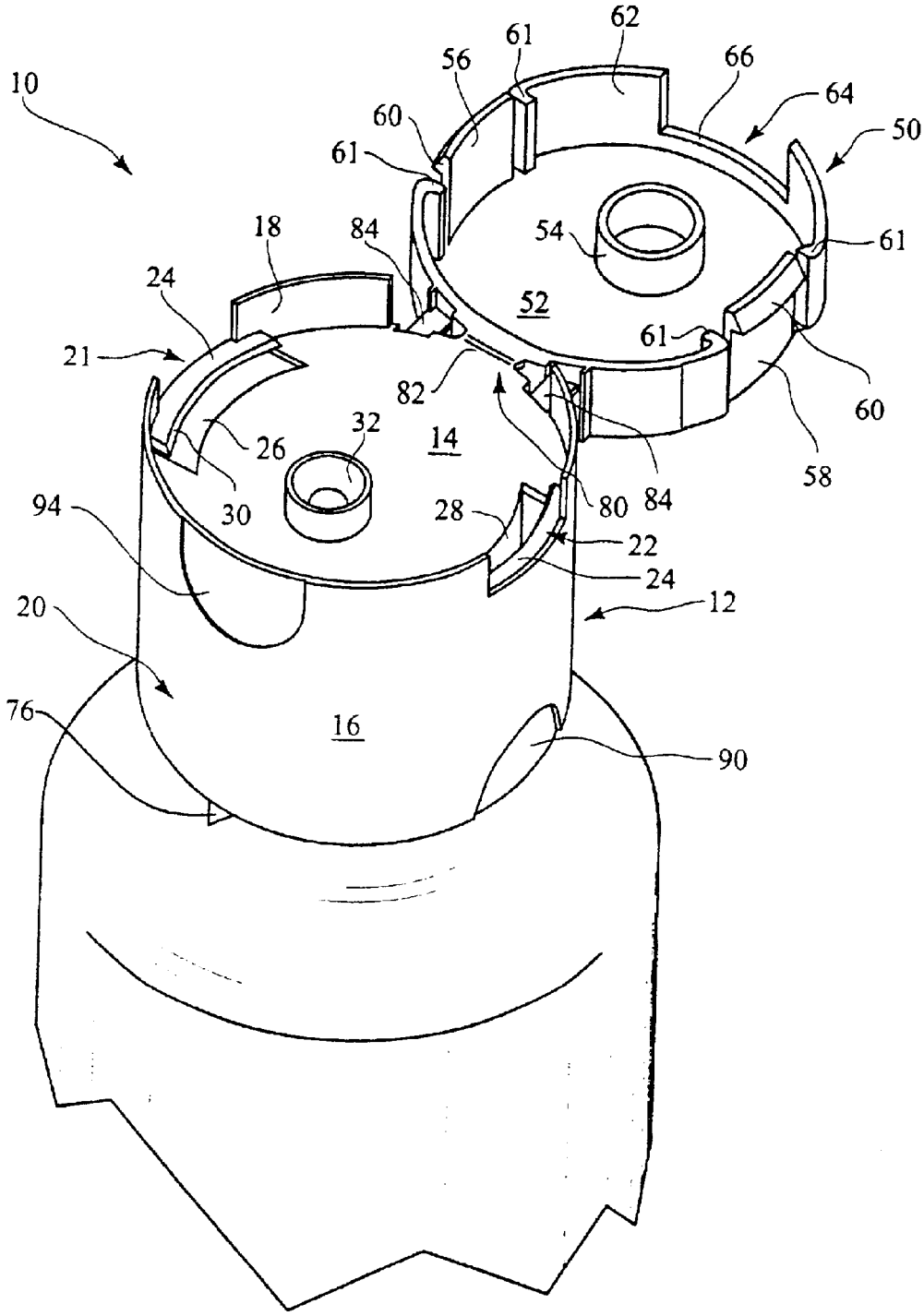
FIG. 1 shows a perspective view of the child resistant dispenser in the open position.
Figure 2:
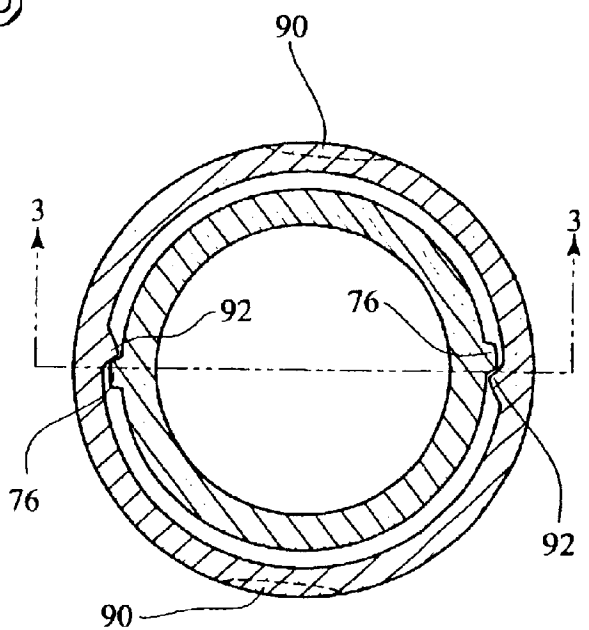
FIG. 2 shows a bottom sectional view of the closure and a container.
Figure 3:
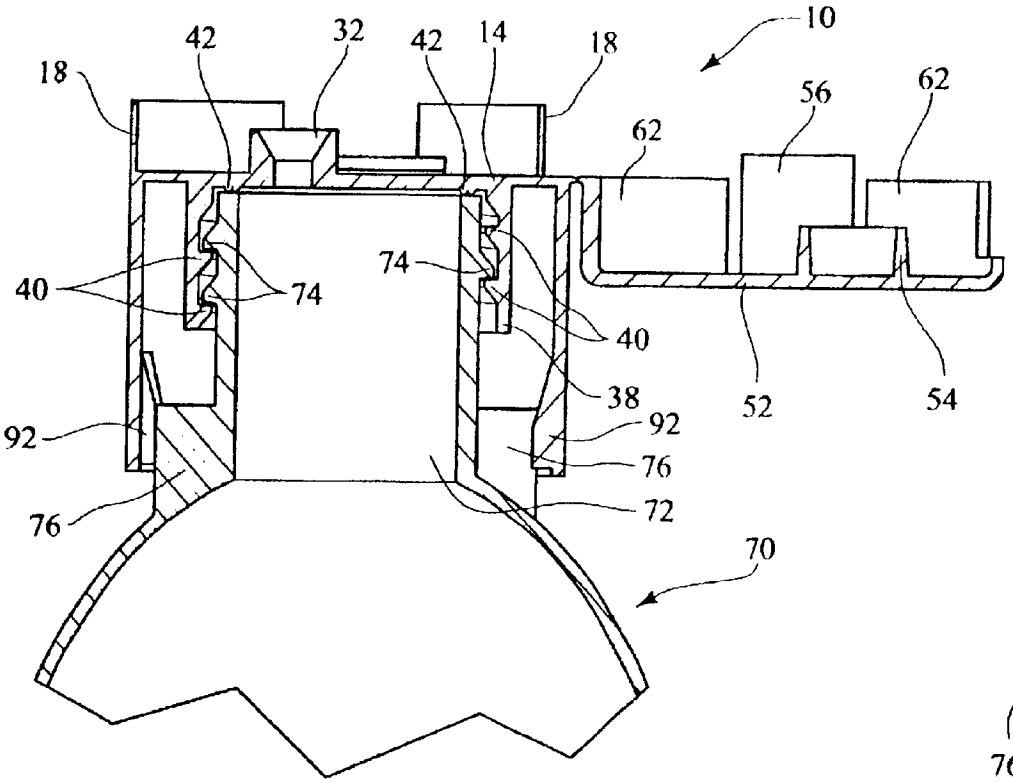
FIG. 3 shows a sectional view of the child resistant dispenser of the present invention along line 3—3 of FIG. 2.

The child resistant dispenser 10 of the present invention comprising a double shelled closure 12 hingeably attached by a hinge mechanism 80 to a lid 50, preferably a flip-top lid, is depicted in FIGS. 1–3. The child resistant dispenser 10 is designed for use in combination with containers for household products, medications, chemicals, cosmetics and other poisons having characteristics including hydrocarbons and low viscosity which may be poisonous to adults and those of tender years if inhaled. The child resistant dispenser 10 is disposed on a container and is in fluid communication therewith. The child resistant dispenser 10 of the present invention may be preferably formed of polypropylene or other plastics by injection molding or compression molding and preferably has a child resistant feature such as a "squeeze and turn" design with CR lugs, push-and-turn design, a bayonet lug design, or some other closure CR feature known in the art. The double shell closure 12 has an outer skirt 16 and an inner skirt 38 spaced apart from and substantially concentric therewith. In addition, the flip top lid 50 preferably comprises a child resistant feature also requiring opposed motion in order to open. Therefore, the present CR dispenser has dual opposed motion child resistant features to inhibit aspiration of harmful household products, chemicals, medicines, and the like containing hydrocarbons by those of tender years.

Referring to FIG. 1, the double-shelled closure 12 is comprised of a closure top wall 14 which is preferably circular in shape. Depending and extending from a peripheral edge of the double-shelled closure 12 is the outer skirt 16, forming a first shell of the double-shelled closure 12. The outer skirt 16 is preferably formed of plastic, such as polypropylene having a thickness allowing the outer skirt 16 to flex into an ovalized shape when "pinched" at pressure points spaced apart about 180 degrees. The outer skirt 16 may be straight or tapered and preferably has an upper portion 18 and a lower portion 20. The upper portion 18 of outer skirt 16 extends above the closure top wall 14 in an interrupted or discontinuous pattern forming a first gap 21 and a second gap 22, which are diametrically opposed. The first and second gaps 21,22 are disposed in a spaced configuration and preferably spaced apart about 180 degrees. The upper portion 18 of outer skirt 16 prevents children from raking their teeth across the flip-top lid 50 to gain access to the contents therein.

Adjacent the first and second gaps 21,22 are first and second apertures 26,28. The first and second apertures 26,28 are also preferably spaced apart about 180 degrees and are positioned through the closure top wall 14. The first and second apertures 26,28 are preferably substantially rectangular having two parallel arcuate sides. However, various other sizes and shapes may be used with the invention described herein.

Also disposed along the upper portion 18 of outer skirt 16 through an arc of about 30 degrees is a recessed finger tab or guide 94. The recessed finger guide 94 is positioned opposite the hinge mechanism 80 to aid in opening the flip top lid 50. When the flip-top lid 50 is closed, the recessed finger guide 94 allows a user to lift the lid 50 by lifting on lip 66.

As seen in FIGS. 1 and 3, also disposed on the outer skirt 16 are pressure points 90. The pressure points 90 are recessed finger guides which may be molded into the lower portion 20 of the outer skirt 16 as the CR dispenser 10 is formed. The pressure points 90 are distinguishable on the lower portion 20 of the outer skirt 16 finish to provide a user with visual reference of the location where to squeeze the double shell closure 12. The pressure points 90 are diametrically opposed preferably spaced apart about 180 degrees from each other and about 90 degrees apart from child resistant lugs 92. The CR lugs 92 are also diametrically opposed, disposed along an inner surface of the lower portion 20 of outer skirt 16, and provide cam surfaces which engage container lugs 76 disposed along a container shoulder or neck 72. The child resistant lugs 92 cam over lugs disposed on a container shoulder 72 when the CR dispenser 10 is fully positioned on the container 70. More specifically, the outer skirt 16 will flex as the CR lugs 92 move into abutment with the container lugs 76, locking the closure 12 in place. The CR lugs 92 are preferably shaped having at least one tapered side, which facilitates passage of the CR lug 92 past a container lug as the double shell closure is rotated onto the container 70. When the pressure points 90 are depressed by a user, the force causes the outer skirt 16 to flex into an oval shape, thus moving each CR lug 92 out of engagement with container lugs 76. This motion allows the double shell closure 12 to be threadably removed from the container 70.

As best shown in FIG. 2, depending from a lower surface of the closure top wall 14 is an inner skirt 38 which is preferably molded with the outer skirt 16 to form the double shell closure 12. Helically extending about an inner surface of the inner skirt 38 is a thread 40. The thread 40 operably engages a thread helically disposed about an external portion of a container neck 72. The inner skirt 38 preferably has a thickness which will not substantially deform when pressure points 90 on the outer skirt 16 are depressed causing ovalized deformation of the outer skirt 16. The thickness of the inner skirt 38 in combination with a seal 42, depending from the closure top wall 14 prevents deformation of the inner skirt 38 and leakage of contents of the container.

A plurality of seals may be used to seal the contents of the container 70 including a rotary seal, a plug seal, or as shown in FIG. 3, a linerless folding bead seal. The seal 42, is downwardly directed from closure top wall 14 to contact an upper surface of the container neck used in combination herewith. However, the seal may also extend from an inner surface of the inner skirt forming a seal near the upper portion of the container neck. The seal 42 preferably sealingly engages the container 70 when the closure 12 is disposed on the container 70 and the first child resistant feature is engaged or locked.

Above the arcuate apertures 26,28 are shoulders 24 extending radially inward from the upper portion 18 of outer skirt 16. The shoulders 24 may have two parallel arcuate sides, the radially inward arcuate side preferably having a tapered edge 30. The tapered edge 30 facilitates easy passage of a prong 56,58 in order to engage the second CR feature.

Positioned on a top surface of the closure top wall 14 is a dispensing orifice or fitment 32. The dispensing orifice 32 is in fluid communication with a container 70 to which the CR dispenser 10 is attached. The dispensing orifice 32 is preferably tapered either along an outer surface, an inner surface, or both. The dispensing orifice 32 is also preferably circular in shape but may be other shapes which still allow for a sealing engagement.

Figure 4:
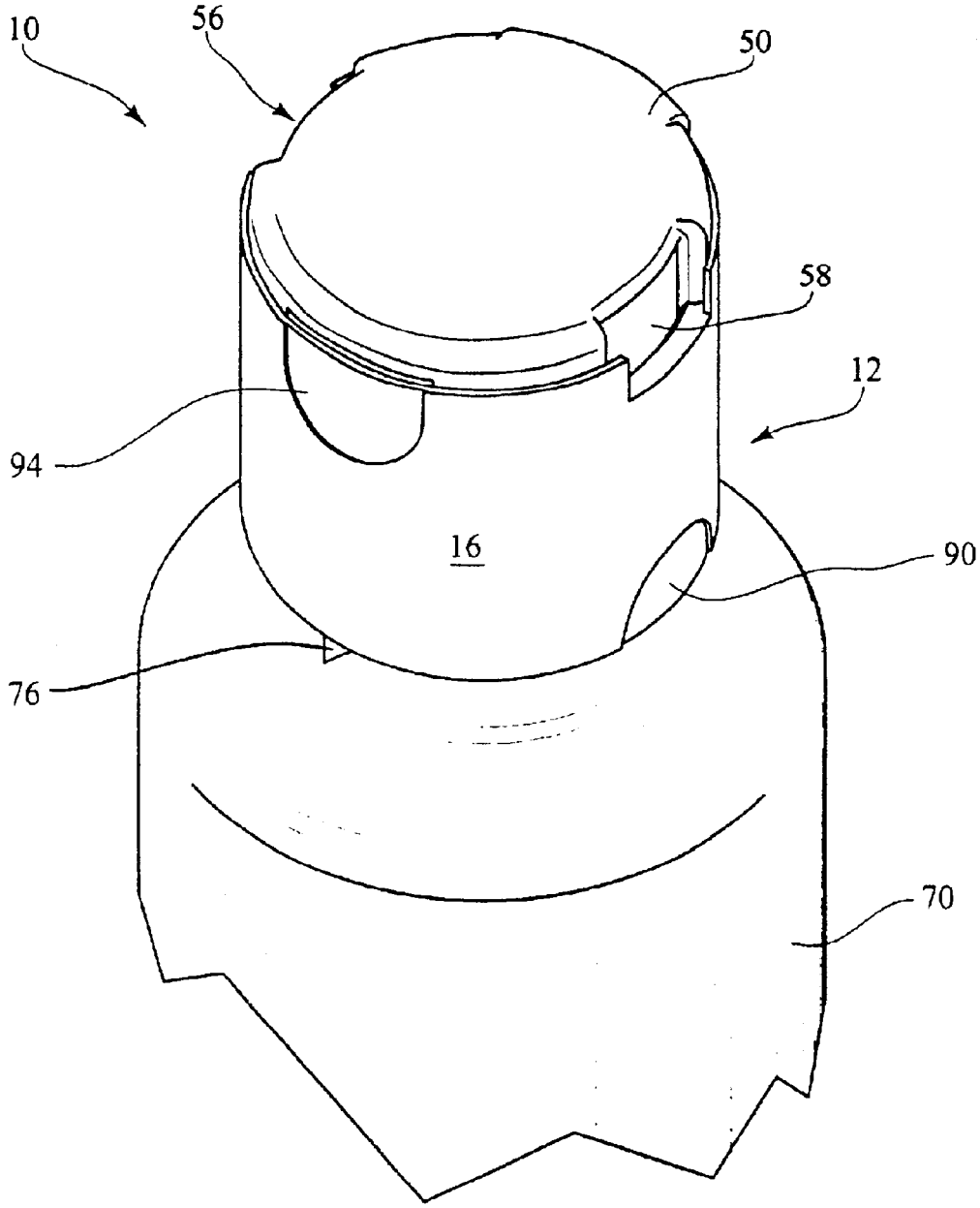
FIG. 4 shows a perspective view of the child resistant closure with child resistant flip-top lid of FIG. 1 in the closed position.

A flip-top lid 50 is retained upon the closure 12 by a hinge mechanism 80 and is rotatable thereon. The flip-top lid 50 is designed to remain on the double-shelled closure 12 after an initial opening. The flip-top lid 50 is primarily comprised of a lid top wall 52 being circular in shape and preferably formed in an injection molding or compression molding process. Depending from a peripheral edge of the lid top wall 52 is an interrupted or discontinuous lid skirt 62. The lid skirt 62 has ribs 61 providing strength to the discontinuous lid skirt 62 as well as providing a recess wherein a user clearly identifies a place to open the flip-top lid 50. However, as seen in FIG. 4 this recess does not allow opening of the lid 50 by children's teeth, known as "biting".

The flip-top lid 50 also comprises a child resistant feature working in combination with the first and second apertures 26,28. Depending from the lid top wall 52 within the discontinuous portions of the lid skirt 62 are a first prong and a second prong 56,58. The first and second prongs 56,58 are preferably spaced apart about 180 degrees. The first and second prongs 56,58 may be substantially rectangular in shape having two parallel arcuate sides with radii substantially equal to that of the lid top wall 52. This provides an aesthetically pleasing appearance as well as a shape which may properly engage first aperture 26 and second aperture 28. At an end of the first and second prongs 56,58 and opposite the lid top wall 52 are fingers 60, best shown in FIG. 1. The fingers 60 have an outer tapered or beveled edge which engages tapered edge 30 of shoulder 24 as the flip top lid 50 is closed. When the fingers 60 move past the shoulders 24, fingers 60 lock below shoulder 24 maintaining the flip-top lid 50 in a closed position and providing the second child resistant feature. When the first and second prongs 56,58 are squeezed by applying an opposed motion, the fingers 60 move radially inward clearing the shoulders 24 wherein the flip-top lid 50 may be lifted open.

The discontinuous lid skirt 62 also comprises a removed portion 64 along a front edge of the lid 50. The removed portion 64 is located opposite the hinge mechanism 80 and is preferably adjacent the finger tab 94 when the lid 50 is in the closed position. A lip 66 is defined by the removed portion 64. When the lid 50 is in the closed position, the finger tab 94, in combination with the lip 66, allows easy opening of the flip-top lid 50 when the first and second prongs 56,58 are released.

Figure 5:
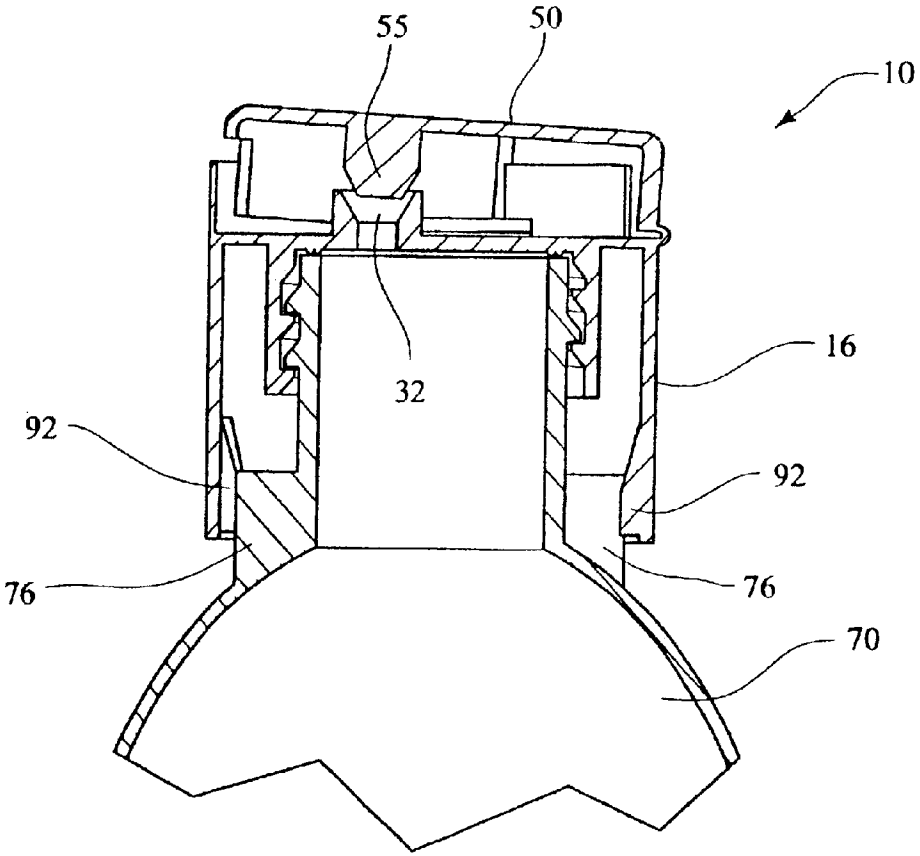
FIG. 5 shows a perspective view of the child resistant dispenser having an orifice plug.

Depending from the lid top wall 52 is a wrap around seal 54 as shown in FIGS. 1, 3. The wrap around seal or fitment 54 is preferably aligned with dispensing orifice 32 to fit over the dispensing orifice 32 when the flip-top lid 50 is disposed in a closed position. In the alternative, a orifice plug 55 may be used instead of a wrap around seal 54 as shown in FIG. 5. The orifice plug 55 may have a tapered surface which fits within the tapered inner surface of the dispensing orifice 32 thus inhibiting fluid movement through the dispensing orifice 21.

Figure 8:
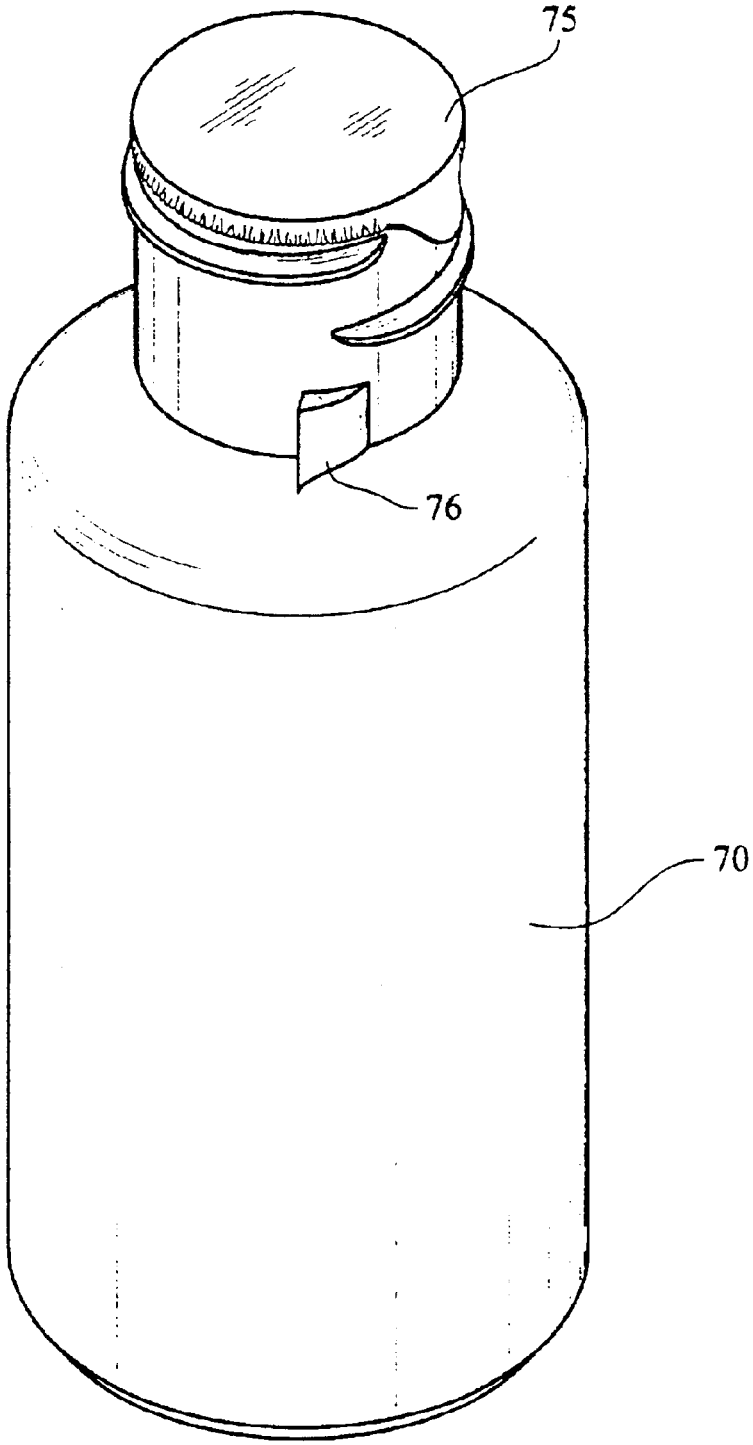

An inner-seal or foil seal 75 shown in FIG. 8, may be disposed adjacent the closure top wall 14. The inner seal 75 may be induction welded on the container neck when the CR dispenser is placed on the container during manufacturing. It is preferable to use a wrap around seal 54 in the event an inner seal 75 is used on the container 70. If an orifice plug 55 is used with an inner seal 75, the orifice plug 55 may puncture the inner seal 75 as it extends through the dispensing orifice and closure top wall. Thus, if a orifice plug 55 is to be used with an inner seal 75 great care must be taken to ensure the inner seal 75 is not damaged.

Figure 7:
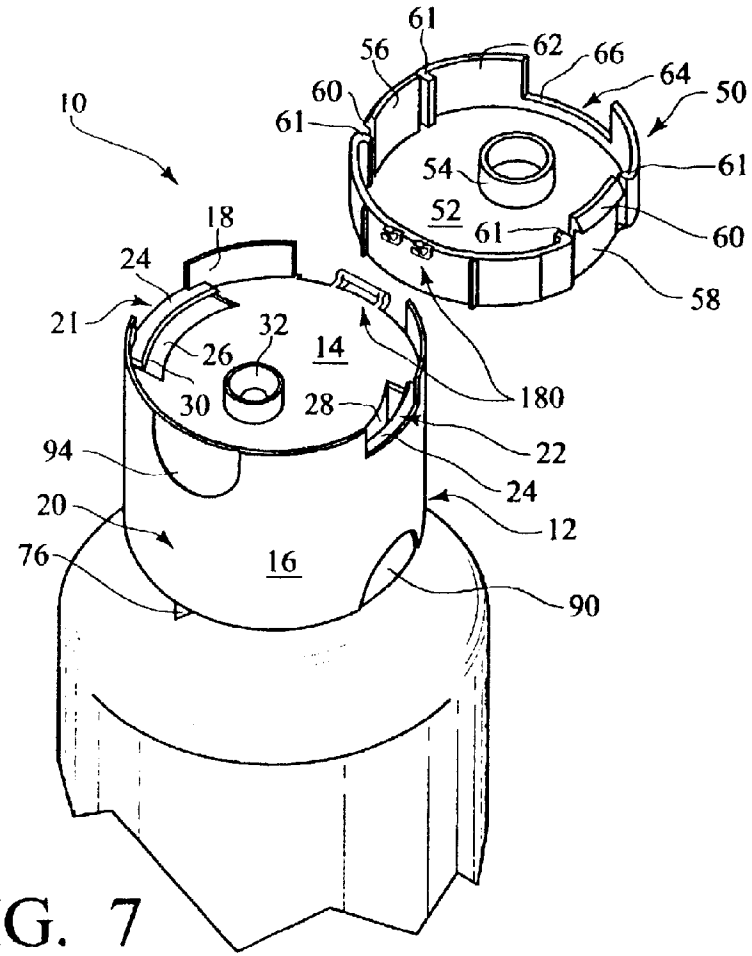
FIG. 7 shows a perspective view of the child resistant closure of FIG. 6 wherein the closure is separate from the flip-top lid; and, FIG. 8 shows a perspective view of the container and an inner seal disposed on the container neck.
Figure 6:
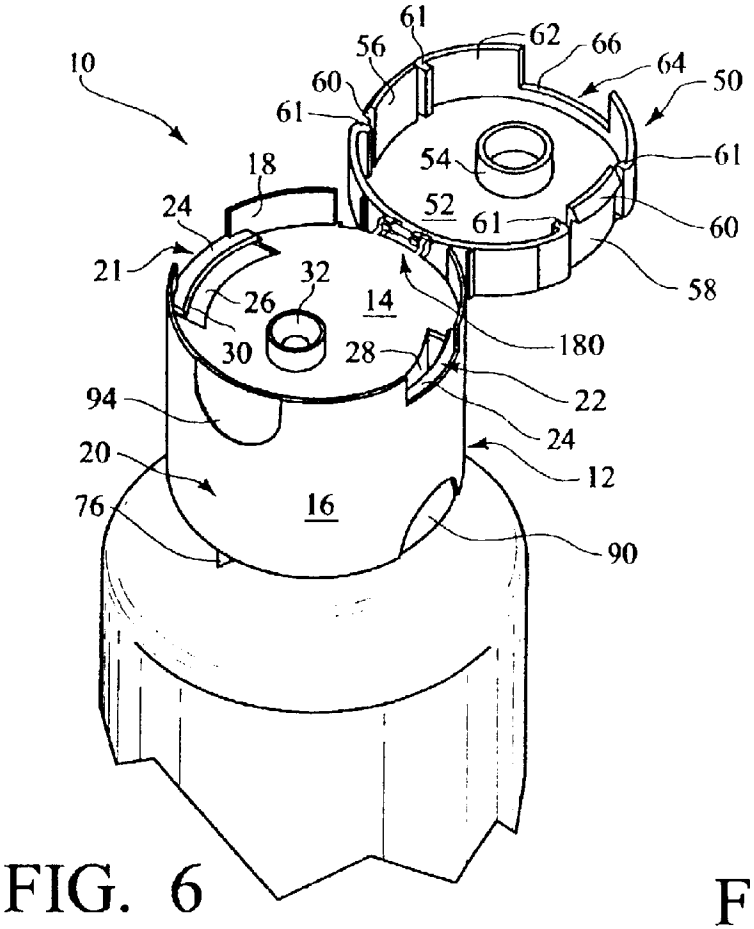
FIG. 6 shows a child resistant dispenser of the present invention having an alternative hinge embodiment.

As mentioned above, a hinge mechanism 80 is used to rotatably connect the flip-top lid 50 and the double shell closure 12. A hinge element 82 extends from the flip-top lid 50 to the double-shell closure 12 to provide a first rotatable connection. The hinge element 82 is preferably formed of a thin flexible plastic. On each side of the hinge element 82 are bias straps 84. The bias straps 84 provide a connection between the flip-top lid 50 and double shell closure 12 as well as maintain the flip-top lid 50 in either a substantially open or substantially closed position. The bias straps 84 are preferably tapered in shape due to the curvature of the closure 12 and flip-top lid 50. The tapered shape of the bias straps 84 provides the bias maintaining the flip top lid 50 in either the substantially open or closed position. In the alternative, various other hinge mechanisms may be used in place of the hinge mechanism 80 described above. For example, it may be helpful to mold the flip-top lid separately of the double-shelled closure 12 in which case a snap together hinge 180 may be used as shown in FIGS. 6 and 7. The hinge 180 may comprise a pivot bar and grasping fingers which allow rotation about the pivot bar. However, one of ordinary skill in the art will recognize a plurality of hinge designs may be used with the instant invention.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A child resistant dispenser, comprising:

a double shelled threaded closure having a first child resistant feature;

a lid hingeably attached to said closure and having a second child resistant feature;

wherein said first and second child resistant features are opposed motion child resistant features.

2. The child resistant dispenser of claim 1 said closure comprising a closure top wall and an outer skirt having an upper portion and a lower portion.

3. The child resistant dispenser of claim 2, wherein said outer skirt is disposed about a peripheral edge of said closure top wall.

4. The child resistant dispenser of claim 1 further comprising a dispensing orifice on a closure top wall.

5. The child resistant dispenser of claim 1, further comprising an inner skirt depending from a closure top wall.

6. The child resistant dispenser of claim 5, said inner skirt having a thread helically extending about an inner surface of said inner skirt.

7. The child resistant dispenser of claim 5, said closure top wall further comprising a seal.

8. The child resistant dispenser of claim 1, said closure having an outer skirt upper portion extending above a closure top wall, said outer skirt upper portion being discontinuous.

9. The child resistant dispenser of claim 1 further comprising a first aperture in a closure top wall and a first shoulder extending above said first aperture.

10. The child resistant dispenser of claim 9 further comprising a second aperture in said closure top wall and a second shoulder extending above said second aperture.

11. The child resistant dispenser of claim 10, said first and second apertures disposed in said closure top wall being in a spaced configuration.

12. The child resistant dispenser of claim 11, said first and second aperture being spaced apart about 180 degrees.

13. The child resistant dispenser of claim 1, further comprising a hinge mechanism including a center hinge element and two symmetrically disposed bias traps.

14. The child resistant dispenser of claim 1, said lid further comprising an orifice plug depending therefrom.

15. The child resistant dispenser of claim 1, said lid further comprising a wrap around seal depending therefrom.

16. The child resistant dispenser of claim 1, said lid comprising a lid top wall and an discontinuous lid skirt depending from a peripheral edge of said lid top wall.

17. The child resistant dispenser of claim 16, further comprising a first prong and a second prong depending from said lid top wall in a spaced configuration.

18. The child resistant dispenser of claim 17, said first prong and said second prong each having an outwardly extending finger opposite said lid top wall.

19. The child resistant dispenser of claim 16 said discontinuous lid skirt further comprising a removed portion defining a lip.

20. The child resistant dispenser of claim 1, further comprising an outer skirt having first and second pressure points diametrically opposed.

21. A child resistant dispenser, comprising:

a double shelled closure having a lid hingeably attached to said closure;

an outer skirt depending from an outer peripheral edge of a closure top wall and having first and second child resistant diametrically opposed lugs extending from an inner surface thereof;

an inner skirt depending from said closure top wall and spaced from said outer skirt having a thread helically extending about an inner surface of said inner skirt;

said closure top wall also including a seal;

said closure top wall including a dispensing orifice and first and second apertures;

said lid having a second child resistant feature including first and second prongs depending from a lid top wall and extending through said first and second apertures when said lid is disposed in a closed position;

said first and second prong each including a finger opposite said lid top wall.

22. The child resistant dispenser of claim 21, further comprising a wrap-around seal depending from said lid top wall and aligned with said dispensing orifice.

23. A child resistant dispenser, comprising:

a closure having a top wall and an annular skirt; diametrically opposed pressure points spaced about a lower portion of said annular skirt for a first opposed motion child resistant feature;

said annular skirt having child resistant lugs disposed about an inner surface of said annular skirt each about 90 degrees from said pressure points; and, a flip-top lid rotatably attached to said closure having a second opposed motion child resistant feature requiring squeezing of diametrically opposed prongs to open said lid.

24. The child resistant dispenser of claim 23, said closure top wall having first and second arcuate apertures.

25. The child resistant dispenser of claim 24, said first and second diametrically opposed arcuate prongs depending from said flip-top lid, and having a finger extending radially outward therefrom.

26. The child resistant dispenser of claim 25, further comprising a shoulder extending above said first and second apertures operably engaging said fingers of said first and second prongs.

27. The child resistant dispenser of claim 23 said closure top wall further comprising a dispensing orifice.

28. The child resistant dispenser of claim 27 further comprising a wrap around seal depending from said flip-top lid.

29. The child resistant dispenser of claim 27 further comprising an orifice plug depending from said flip-top lid.

30. The child resistant dispenser of claim 27 further comprising a hinge mechanism.

31. The child resistant dispenser of claim 30, said binge mechanism comprising a hinge element and symmetrically disposed bias straps.

32. A child resistant dispenser, comprising:

a double shelled closure having a first opposed motion child resistant feature and a second opposed motion child resistant feature, said first child resistant feature being a squeeze-and-turn feature, said second child resistant feature is a squeeze and lift feature, said double shelled closure having an inner skirt depending from a closure top wall, a seal depending from said closure top wall, an outer skirt depending from a peripheral edge of said closure top wall, said outer skirt having a pair of diametrically opposed child resistant bags extending from an inner surface of said outer skirt, a pair of diametrically opposed pressure points on an outer surface of said outer skirt spaced about 90 degrees from said child resistant lugs, first and second apertures diametrically opposed in said closure top wall and a dispensing orifice in said closure top wall, said flip-top lid having a lid top wall and a lid skirt depending from said lid top wall, a first and a second prong depending from said lid top wall, said first and second prongs being spaced apart about 180 degrees along said peripheral edge of said lid top wall and having fingers disposed thereon, said first and second prongs aligned with said first and second aperture of a closure top wall.

* * * * *